US009654882B2

(12) United States Patent
Akino

(10) Patent No.: US 9,654,882 B2
(45) Date of Patent: May 16, 2017

(54) CONDENSER MICROPHONE AND METHOD OF MANUFACTURING CONDENSER MICROPHONE

(71) Applicant: Hiroshi Akino, Tokyo (JP)

(72) Inventor: Hiroshi Akino, Tokyo (JP)

(73) Assignee: KABUSHIKI KAISHA AUDIO TECHNICA, Tokyo (JP)

( * ) Notice: Subject to any disclaimer, the term of this patent is extended or adjusted under 35 U.S.C. 154(b) by 0 days.

(21) Appl. No.: 14/989,891

(22) Filed: Jan. 7, 2016

(65) Prior Publication Data

US 2016/0212550 A1 Jul. 21, 2016

(30) Foreign Application Priority Data

Jan. 15, 2015 (JP) ..... 2015-005710

(51) Int. Cl.

| | |
|---|---|
| ***H04R 25/00*** | (2006.01) |
| ***H04R 19/04*** | (2006.01) |
| ***H04R 31/00*** | (2006.01) |
| *H04R 9/08* | (2006.01) |

(52) U.S. Cl.
CPC ..... *H04R 19/04* (2013.01); *H04R 31/006* (2013.01)

(58) Field of Classification Search
CPC ..... H04R 19/04; H04R 31/006
USPC ..... 381/361–363, 355, 369, 174
See application file for complete search history.

(56) References Cited

U.S. PATENT DOCUMENTS 7,330,559 B2 * 2/2008 Akino ..... F16L 27/10 381/361

FOREIGN PATENT DOCUMENTS

JP 4417801 B 2/2010

* cited by examiner

*Primary Examiner* — Sunita Joshi
(74) *Attorney, Agent, or Firm* — Whitham, Curtis & Cook

(57) ABSTRACT

Provided is a condenser microphone including an audio-signal outputting printed circuit board and a rear case that are in stable electrical connection with each other. The condenser microphone includes a microphone unit 10, an audio-signal outputting printed circuit board 20 connected with the microphone unit 10, a rear case 30 having deep groove 31*a*, the deep groove 31*a* receiving the audio-signal outputting printed circuit board 20, a mounting groove 31*b* being formed on the outer periphery of the rear case 30, the mounting groove 31*b* receiving a mounting member 50, a fitting groove 21 being formed on the audio-signal outputting printed circuit board 20, the fitting groove 21 receiving the mounting member 50.

14 Claims, 11 Drawing Sheets

CONDENSER MICROPHONE AND METHOD OF MANUFACTURING CONDENSER MICROPHONE

TECHNICAL FIELD

The present invention relates to condenser microphone and a method of manufacturing the condenser microphone.

BACKGROUND ART

Some unidirectional condenser microphone unit that are used for conferences, for example, each include an audio-signal outputting printed circuit board (PCB) attached to the rear portion of a microphone unit (hereinafter, referred to as "unit") to downsize the condenser microphone. The external housing of the condenser microphone consists of three components; a cap covering the front end (adjacent to a sound source) of the unit, a cylindrical shaped microphone case accommodating the unit and the PCB, and the rear case surrounding the rear portion (remote from the sound source) of the PCB. A microphone cable extracting audio-signals output from the condenser microphone is disposed in the rear case. For a gooseneck microphone, a flexible pipe is connected with the rear case.

The three components of the external housing of the condenser microphone are made of metal and are coupled so that the external housing forms an electrostatic shield. If the electrical connections among the coupling portions are unstable, intense electromagnetic waves applied to such coupling portions generate radio frequency (RF) current, which intrudes into the interior of the condenser microphone. As a result, the unit detects the RF current to output it as noise. The noise output from the unit increases if the electrical connection is unstable, in particular, between the microphone case and the rear case or between the PCB and the rear case.

In the conventional condenser microphone, the microphone case is coupled to the rear case with several screws (three screws, for example) that are screwed from the outer periphery of the microphone case. The microphone case is in contact with the rear case only at parts of the inner periphery deformed by the screwed screws. A larger number of screws used to couple the microphone case to the rear case enhance the electrical connection between the microphone case and the rear case, however, this leads to an inferior appearance of the condenser microphone.

In the conventional condenser microphone, the PCB is coupled to the rear case by which a metal plate shaped spring, for example, attached to the PCB is in contact with the rear case. The microphone is a compact microphone including a microphone case having an outer diameter of approximately 12 mm. Therefore, it is difficult through a mechanical process to form the rear case into a structure for mechanically fixed to the PCB.

FIG. 12 is an exploded perspective view of a conventional condenser microphone. The condenser microphone includes a cap 2, a microphone case 3, a unit 10, a PCB 200, and a rear case 300.

FIG. 13 is an exploded side cross-sectional view of the condenser microphone illustrated in FIG. 12.

The microphone case 3 is made of metal and is in a hollow cylindrical shape. The cap 2 is attached to a front portion of the microphone case 3 so as to cover the open front end of the microphone case 3 from the outside of the microphone case 3. Thread holes 3*h* are formed on the surface of the rear portion of the microphone case 3. Screws 40 (illustrated in FIG. 12) are inserted into these thread holes 3*h*.

The unit 10 includes a unit case that is made of metal and has an opening, a diaphragm and a fixed electrode constitute a capacitor, and a circuit board that converts a variation in electrostatic capacitance generated between the diaphragm and the fixed electrode into electric signals. The unit case accommodates the capacitor and the circuit board. A sound introducing hole through which sound waves from the sound source pass is formed at the bottom surface (a surface opposite to the opening) of the unit case. The circuit board is fixed in the interior of unit case so as to close the opening of the unit case from the inside of the unit case by curling of the rear edge portion of the unit case.

The PCB 200 is in a rectangular plate shape in plan view. The PCB 200 has cutouts 222 at the front end portion in connection with the unit 10.

The rear case 300 is made of metal and includes a large-diameter portion 331, a middle-diameter portion 332, a small-diameter portion 333, and a flange 334. Deep grooves 331*a*, receiving the rear portion of the PCB 200, and thread holes 331, communicating with the thread holes 3*h*, are formed on the large-diameter portion 331.

FIG. 14 is a side cross-sectional view of the condenser microphone illustrated in FIG. 12. The rear end of the microphone case 3 abuts on the flange 334 of the rear case 300 such that the microphone case 3 is coupled to the rear case 300. The rear portion of the PCB 200 is received in the deep grooves 331*a* of the rear case 300. The unit 10 and the PCB 200 are accommodated in the microphone case 3.

A plate spring 400 is made of metal and electrically connects the PCB 200 and the rear case 300. The plate spring 400 is fixed to the PCB 200 and the rear case 300. For example, one end of the plate spring 400 is attached to the rear case 300, while the other end of the plate spring 400 is disposed between the rear portion of the PCB 200 and the deep grooves 331*a*.

FIG. 15 is a cross-sectional plan view of the condenser microphone illustrated in FIG. 12. The microphone case 3 is electrically connected with the rear case 300 through the screws 40.

The use of such a metal plate spring to establish stable electrical connection between the PCB and the rear case is disclosed (for example, refer to Japanese Patent No. 4417801).

SUMMARY OF INVENTION

Technical Problem

In the conventional condenser microphone, the electrical connection between the microphone case 3 and the rear case 300 only through the screwed screws 40 is unstable, as described above. In such a condition, the electrical connection between the PCB 200 and the ground of the rear case 300 through the plate spring 400 is also unstable because of high frequency impedance of the plate spring 400. To address the problem, required is a condenser microphone which includes a PCB 200 and a rear case 300 that are mechanically coupled to each other and are electrically connected with each other.

An object of the present invention, which has been made to solve the problem described above, is to provide a condenser microphone that can establish stable electrical connection between a microphone case and a rear case, in particular, between an audio-signal outputting printed circuit board and a rear case, and a method of manufacturing such a condenser microphone.

Solution to Problem

The condenser microphone of the present invention includes a microphone unit, an audio-signal outputting printed circuit board connected with the microphone unit, a rear case having deep groove, the deep groove receiving the audio-signal outputting printed circuit board, a mounting groove being formed on the outer periphery of the rear case, the mounting groove receiving a mounting member, a fitting groove being formed on the audio-signal outputting printed circuit board, the fitting groove receiving the mounting member.

Advantageous Effects of Invention

The condenser microphone of the present invention can certainly establish stable electrical connection between the audio-signal outputting printed circuit board and the rear case.

DESCRIPTION OF EMBODIMENTS

Embodiments of the condenser microphone of the present invention and a method of manufacturing the condenser microphone will now be described with reference to the attached drawings.

<Main Components of Condenser Microphone>

Figure 1:
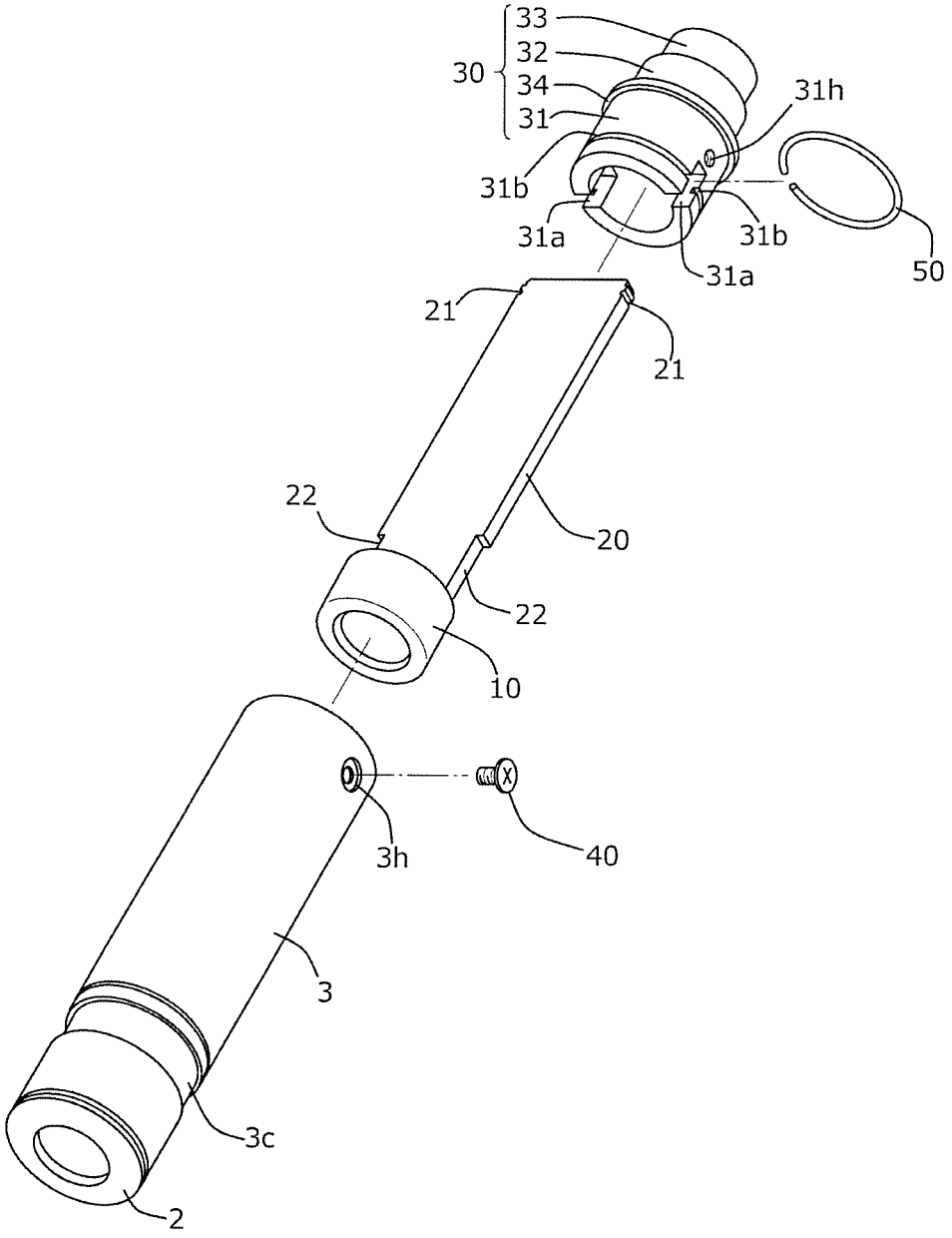
FIG. 1 is an exploded perspective view of a condenser microphone of the present invention.

FIG. 1 is an exploded perspective view of a condenser microphone of the present invention. FIG. 1 illustrates main components of the condenser microphone; a cap 2, a microphone case 3, a microphone unit (hereinafter, referred to as "unit") 10, an audio-signal outputting printed circuit board (hereinafter referred to as "PCB") 20, and a rear case 30.

Figure 2:
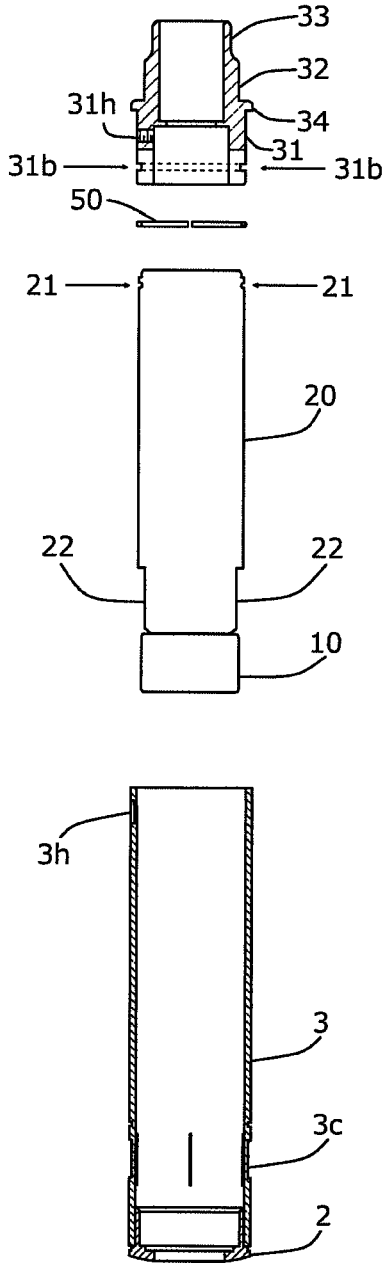
FIG. 2 is an exploded cross-sectional plan view of the condenser microphone illustrated in FIG. 1.

FIG. 2 is an exploded cross-sectional plan view of the condenser microphone illustrated in FIG. 1.

FIGS. 1 and 2 illustrate that the cap 2 is attached to the microphone case 3 and the unit 10 is attached to the PCB 20. In FIGS. 1 and 2, a microphone cable or connector disposed through the rear end of the rear case 30 is not shown.

In the following description, the front end of the condenser microphone is directed to the sound source during sound collection.

The cap 2 is made of metal and is in a doughnut shape in plan view. A sound introducing hole through which sound waves from the sound source pass is formed at the substantial center of the cap 2 in plan view. The cap 2 is attached to a front portion of the microphone case 3 so as to cover the opining at the front end of the microphone case 3 from the outside of the microphone case 3.

The microphone case 3 is made of metal and is in a hollow cylindrical shape. An annular shaped recess 3*c* is formed along the outer periphery of the front portion (adjacent to the cap 2) of the microphone case 3. The recess 3*c* reduces the internal space of the microphone case 3. As a result, the acoustic impedance in the microphone case 3 increases, and thereby the resonant frequency in the microphone case 3 shifts to a higher frequency range. Therefore, degradation in directional frequency response can be prevented in the frequency range lower than the resonant frequency in the internal space of the microphone case 3. A thread hole 3*h* is formed at the rear portion of the microphone case 3. A metal screw 40 is inserted into the thread hole 3*h*.

The unit 10 includes a unit case that is made of metal and is in bottomed cylindrical shape with an opening, a diaphragm and a fixed electrode that constitute a capacitor and is accommodated in the unit case, and a circuit board that is in a disk shape and converts a variation in electrostatic capacitance generated between the diaphragm and the fixed electrode into electric signals. A sound introducing hole through which sound waves from the sound source pass is formed at the bottom surface (a surface directed to the sound source during sound collection and opposite to the opening) of the unit case. The circuit board is fixed in the unit case so as to close the opening of the unit case from the inside of the unit case by curling of the rear edge of the unit case.

The PCB 20 is in an elongated rectangular plate shape in plan view. Fitting grooves 21 are formed at the rear end portion of the PCB 20 (adjacent to the rear case 30). Cutouts 22 are formed on the front portion of the PCB 20 (adjacent to the unit 10).

The fitting grooves 21 are respectively formed at the rear end portion of the PCB 20. The fitting grooves 21 are disposed on the outer edges of the two opposite long sides of the PCB 20. The fitting grooves 21 extend along the depth of the PCB 20 (in the direction perpendicular to the plane of the PCB 20). The fitting grooves 21 are communicated with a mounting groove 31*b* (described below) of the rear case 30 holding the rear end portion of the PCB 20 therein.

The cutouts 22 are respectively formed by notching the front end portions of opposite long sides of the PCB 20. The cutouts 22 are formed in the short direction of the PCB 20. The cutouts 22 define sound paths in the microphone case 3. Sound waves passing through the sound introducing holes (not shown) in the side wall of the microphone case 3 to the interior of the microphone case 3 pass along the sound paths. The sound paths defined by the cutouts 22 reduce the acoustic impedance of the sound introducing holes. Such a configuration can prevent degradation in directional frequency response caused by the resonance between the acoustic mass of the interior space of the microphone case 3 accommodating the PCB 20 and the sound introducing holes on the side wall of the microphone case 3.

The PCB 20 is electrically connected with the circuit board of the unit 10 and transmits electrical (audio) signals output from the circuit board to a connector (not shown). The connector is an output connector including a first pin for grounding, a second pin on the hot signal side, and a third pin on the cold signal side that are in conformance with JEITA Standard RC-5236 "Circular Connectors, Latch Lock Type for Audio Equipment", for example. The PCB 20 is electrically connected with the connector through a microphone cable (not shown). The microphone cable is a double-core shielded cable consisting of a hot signal line, a cold signal line, and a braided shielding wire.

The unit 10 and the PCB 20 are accommodated in the microphone case 3 such that the sound introducing hole of the unit 10 is communicated with the sound introducing hole of the cap 2.

The rear case 30 is made of metal. The rear case 30 has conductivity. The rear case 30 includes a large-diameter portion 31, a middle-diameter portion 32, and a small-diameter portion 33. The middle-diameter portion 32 is disposed between the large-diameter portion 31 and the small-diameter portion 33. The large-diameter portion 31, the middle-diameter portion 32, and the small-diameter portion 33 are in a substantially hollow cylindrical shape, and the interior of them are communicated with each other. The middle-diameter portion 32 has an outer diameter smaller than that of the large-diameter portion 31 and larger than that of the small-diameter portion 33. An annular shaped flange 34 having an outer diameter larger than the large-diameter portion 31 is formed at the boundary between the large-diameter portion 31 and the middle-diameter portion 32 and on the outer periphery of the rear case 30.

Figure 3:
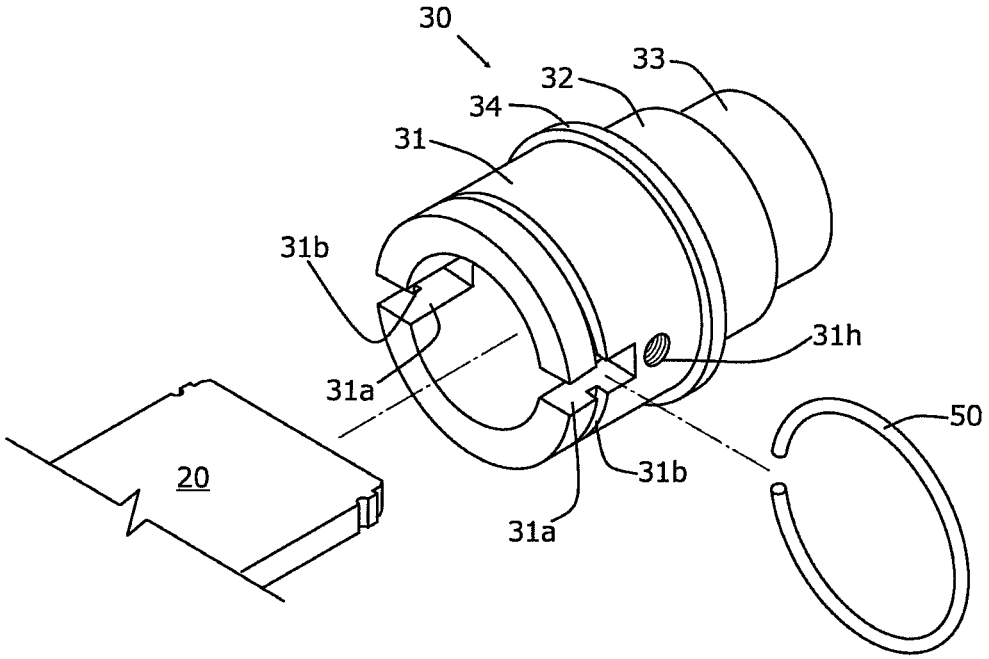
FIG. 3 is an exploded perspective view of the condenser microphone illustrated in FIG. 1, illustrating the rear portion of an audio-signal outputting printed circuit board and a rear case.

FIG. 3 is an exploded perspective view of the rear portion of the PCB 20 and the rear case 30. Deep grooves 31*a*, a mounting groove 31*b*, and a thread hole 31*h* are formed in the large-diameter portion 31.

The deep grooves 31*a* receive the rear end portion of the PCB 20. The deep grooves 31*a* are formed by notching the front end of the large-diameter portion 31 toward the small-diameter portion 33 along the longitudinal direction of the rear case 30. The deep grooves 31*a* are notched grooves.

The mounting groove 31*b* receives a C-ring 50 made of an elastic material and functioning as a mounting member. The mounting member has conductivity. The mounting groove 31*b* is formed on the outer periphery (outer surface) of the large-diameter portion 31 and is in an annular shape conforming to the outer periphery of the large-diameter portion 31. The mounting groove 31*b* communicates with the deep grooves 31*a*. The outer diameter of the rear case 30 at the mounting groove 31*b* is smaller than the inner diameter of the C-ring 50. Such a configuration establishes stable connection between the C-ring 50 and the mounting groove 31*b* (i.e., between the C-ring 50 and the rear case 30).

The screw 40 is screwed in the thread hole 31*h*. The thread hole 31*h* communicates with the thread hole 3*h* of the microphone case 3 holding the large-diameter portion 31 of the rear case 30 therein.

<Method of Manufacturing Condenser Microphone>

A method of assembling (manufacturing) the condenser microphone will now be described. A microphone case 3 provided with a cap 2 attached thereto, a PCB 20 electrically connected with a unit 10, and a rear case 30 are assembled as follows.

Figure 4:
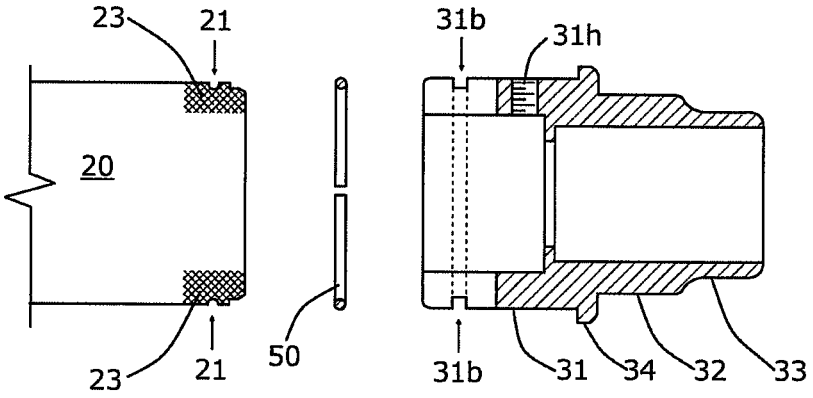
FIG. 4 is an exploded cross-sectional plan view of the rear portion of the audio-signal outputting printed circuit board and the rear case illustrated in FIG. 3.

FIG. 4 is an exploded cross-sectional plan view of the rear portion of the PCB 20 and the rear case 30. Ground lands 23 are provided adjacent to respective fitting grooves 21 of the PCB 20.

The assembling process starts with fitting a C-ring 50 into a mounting groove 31*b*.

Figure 5:
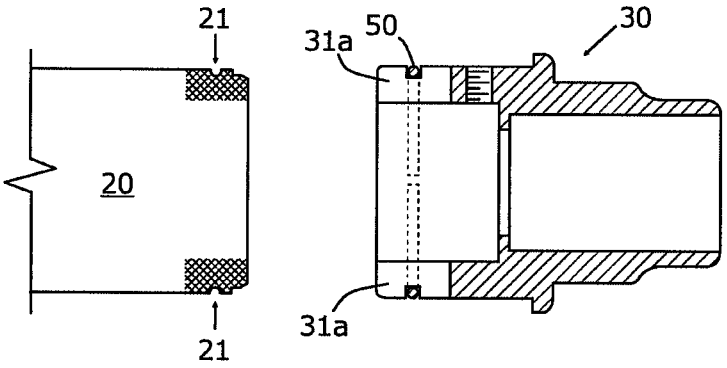
FIG. 5 is an exploded cross-sectional plan view of the rear portion of the audio-signal outputting printed circuit board and the rear case provided with a C-ring fitted thereon illustrated in FIG. 3.

FIG. 5 is an exploded cross-sectional plan view of the rear portion of the PCB 20 and the rear case 30 provided with the C-ring 50 fitted thereon. Part of the outer surface of the C-ring 50 fitted in the mounting groove 31*b* protrudes outwardly from the outer periphery of a large-diameter portion 31 over substantially the entire circumference of the large-diameter portion 31.

In the next step, the rear portion of the PCB 20 having the fitting grooves 21 is received in the deep grooves 31*a* of the rear case 30 provided with the C-ring 50 fitted on the rear case 30. After the insertion of the PCB 20, parts of the C-ring 50 are fitted into the fitting grooves 21. The ground lands 23 adjacent to the respective fitting grooves 21 of the PCB 20 are thereby electrically connected with the C-ring 50.

Figure 6:
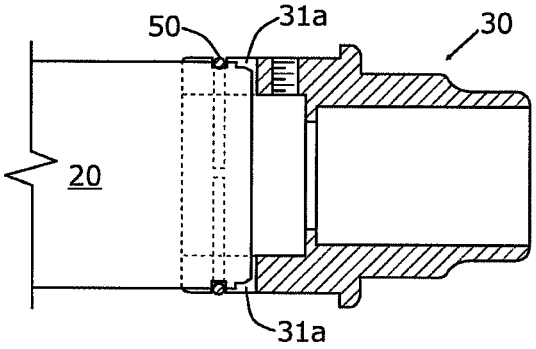
FIG. 6 is a cross-sectional plan view of the rear portion of the audio-signal outputting printed circuit board and the rear case illustrated in FIG. 3.

FIG. 6 is a cross-sectional plan view of the rear portion of the PCB 20 and the rear case 30. In FIG. 6, the rear portion of the PCB 20 is inserted into the deep grooves 31*a* of the rear case 30 provided with the C-ring 50 fitted on the rear case 30. The width in the short direction (the vertical direction in FIG. 6) of the PCB 20 is larger than the inner diameter of the rear case 30 (the large-diameter portion 31) and is smaller than the outer diameter of the rear case 30 (the large-diameter portion 31). The PCB 20 is electrically connected with the rear case 30 through the ground lands 23 and the C-ring 50 fitted in the fitting grooves 21. The electrical connection between the PCB 20 and the rear case 30 comes into stable.

In the next step, the PCB 20 provided with the C-ring 50 fitted in the fitting grooves 21 of the PCB 20 and the front portion (the large-diameter portion 31) of the rear case 30 receiving the rear portion of the PCB 20 are accommodated into the microphone case 3. After the PCB 20 and the front portion of the rear case 30 are accommodated into the microphone case 3, a thread hole 3*h* of the microphone case 3 is communicated with the thread hole 31*h* of the rear case 30. A screw 40, which functions as a fixing member, is inserted from the thread hole 3*h* and screwed in the thread hole 31*h*. The rear case 30 is thereby fixed to the microphone case 3 with the screw 40.

Figure 7:
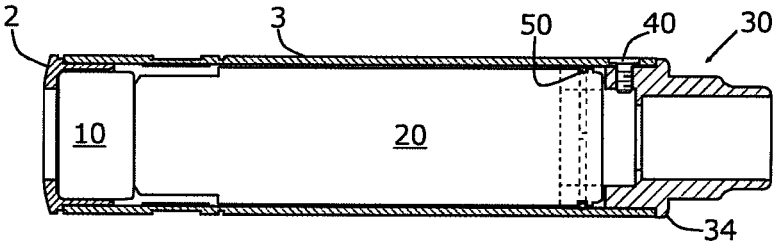
FIG. 7 is a cross-sectional plan view of the condenser microphone illustrated in FIG. 1.

FIG. 7 is a cross-sectional plan view of the condenser microphone.

Figure 8:
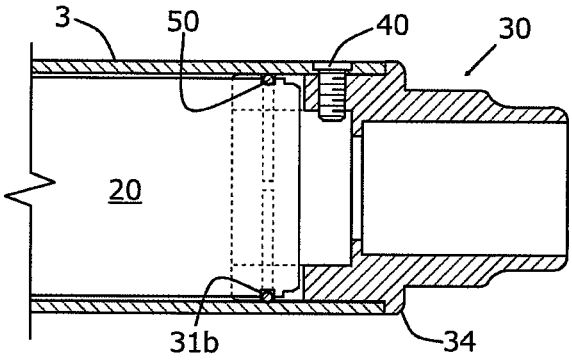
FIG. 8 is a cross-sectional plan view of the rear portion of the microphone case and the rear portion of the audio-signal outputting printed circuit board of the condenser microphone illustrated in FIG. 1.

FIG. 8 is a cross-sectional plan view of the rear portion of the microphone case 3, the rear portion of the PCB 20, and the rear case 30.

Figure 9:
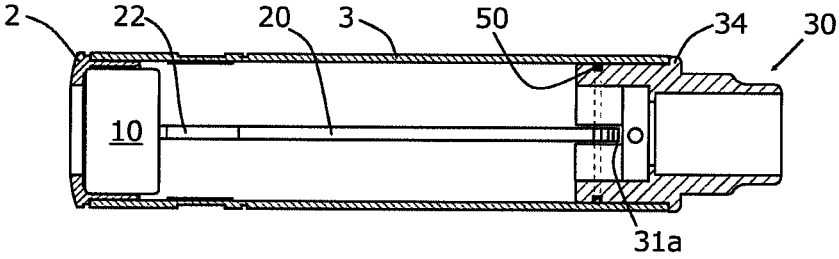
FIG. 9 is a cross-sectional side view of the condenser microphone illustrated in FIG. 1.

FIG. 9 is a cross-sectional side view of the condenser microphone.

In the condenser microphone illustrated in FIGS. 7 and 8, substantially the entire inner periphery of the microphone case 3 is electrically connected with the PCB 20 through the C-ring 50. In addition, the microphone case 3 is electrically connected with the rear case 30 through the screw 40.

With reference to FIGS. 7 to 9, the rear end of the microphone case 3 abuts on the flange 34 of the rear case 30 such that the thread hole 3*h* of the microphone case 3 is communicated with the thread hole 31*h* of the rear case 30.

In the manufacturing method described above, the C-ring 50 is fitted into the mounting groove 31*b* before the rear portion of the PCB 20 is received in the deep grooves 31*a*. Alternatively, the C-ring 50 may be fitted in the mounting groove 31*b* after the rear portion of the PCB 20 is received in the deep grooves 31*a*, in the method of manufacturing the condenser microphone of the present invention.

<Whole of Condenser Microphone>

Figure 10:
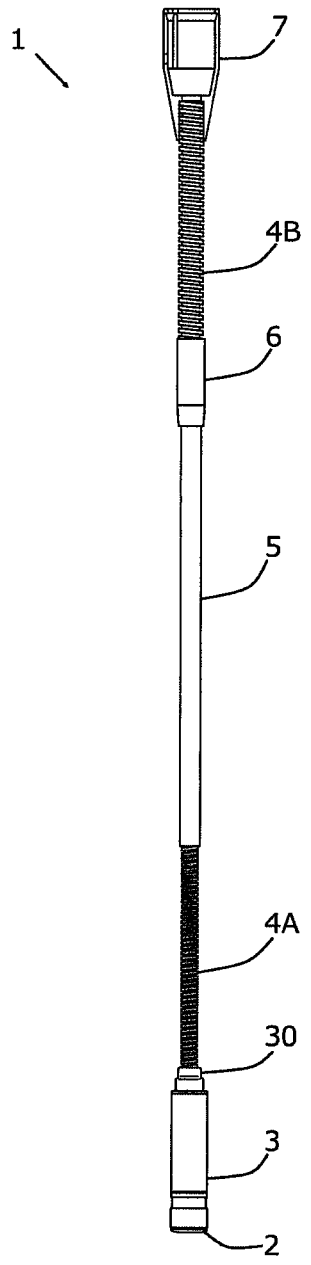
FIG. 10 is an external view illustrating an embodiment of a condenser microphone according to the present invention.
Figure 11:
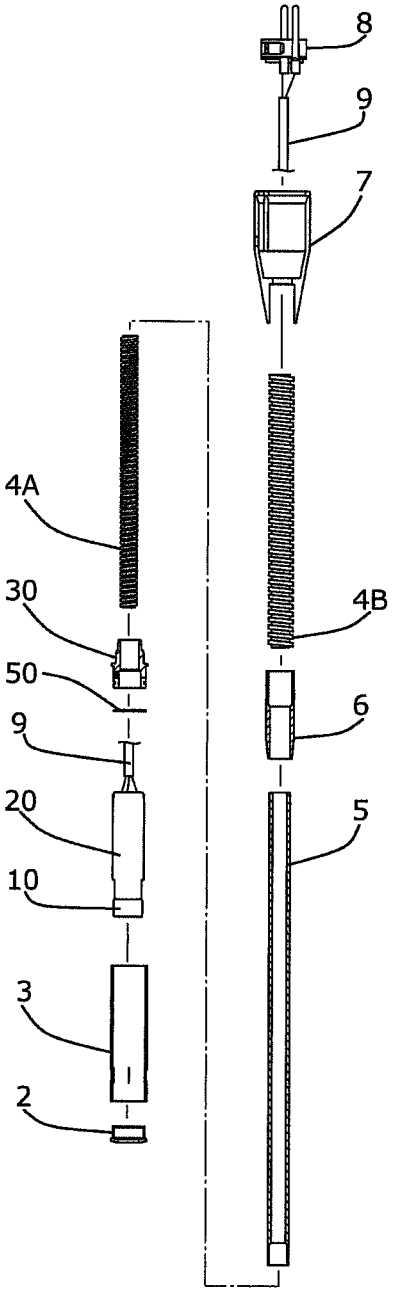
FIG. 11 is an exploded component view of the microphone illustrated in FIG. 10.
Figure 12:
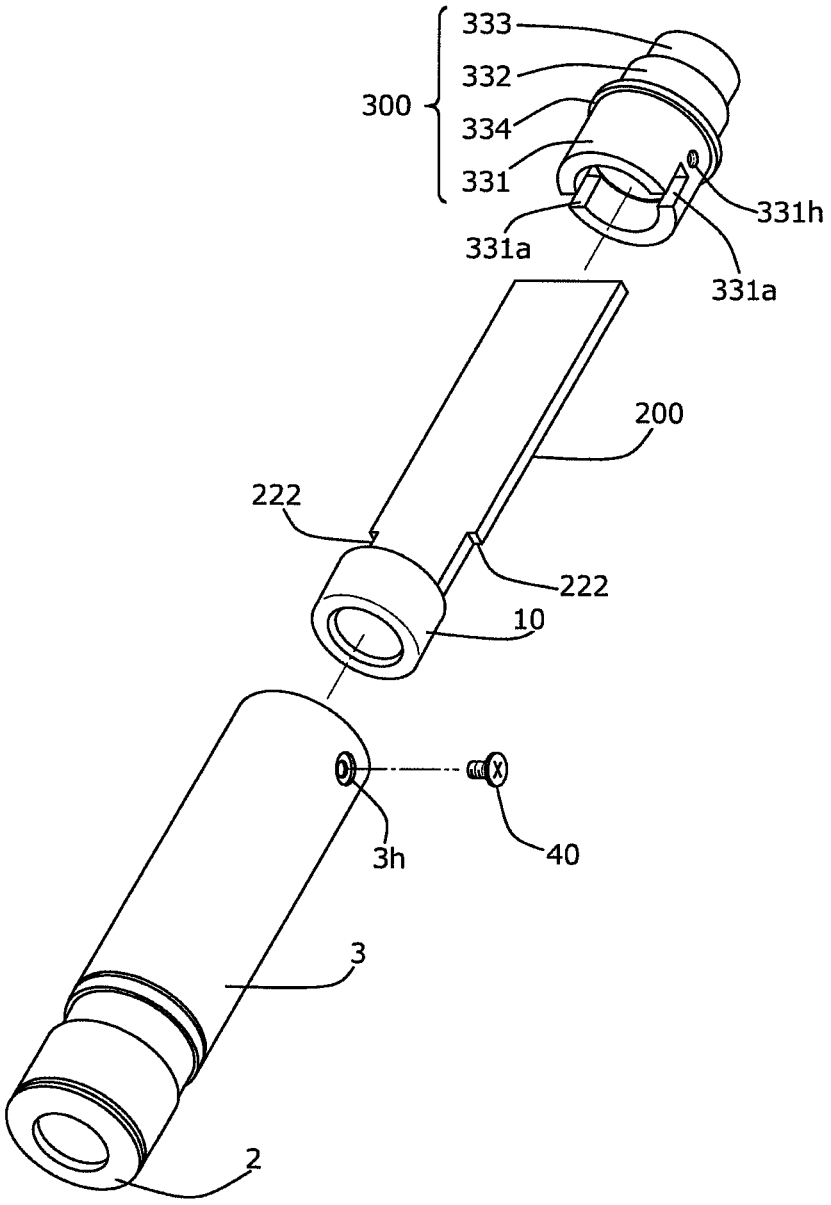
RELATED ART FIG. 12
FIG. 12 is an exploded perspective view of a conventional condenser microphone.
Figure 13:
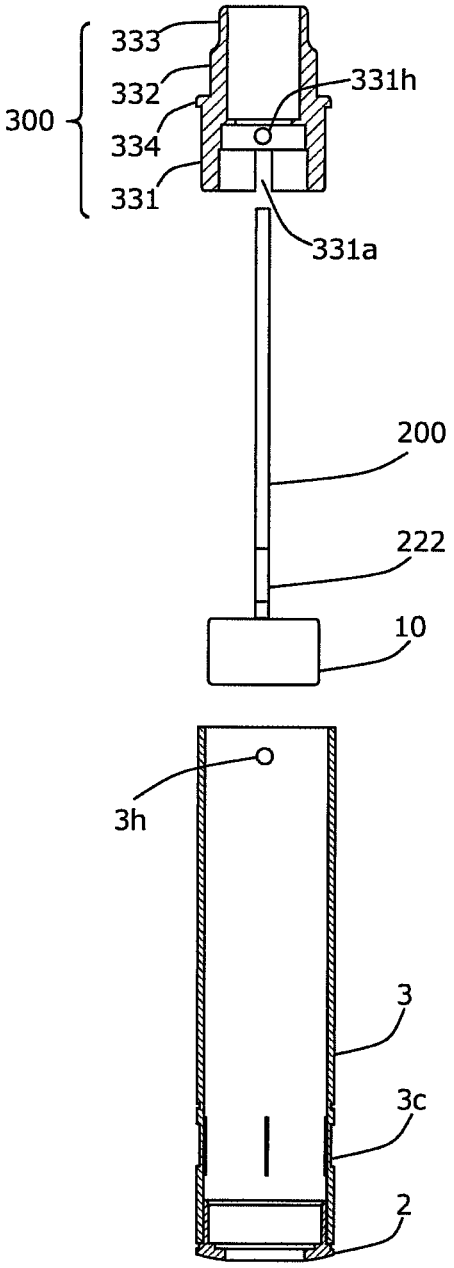
RELATED ART FIG. 13
FIG. 13 is an exploded cross-sectional side view of the conventional condenser microphone illustrated in FIG. 12.
Figure 14:
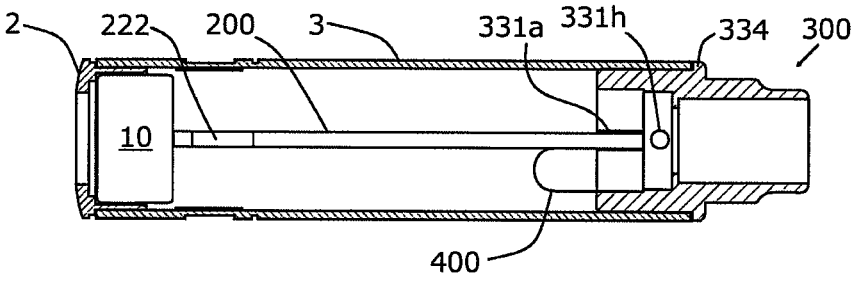
RELATED ART FIG. 14
FIG. 14 is a cross-sectional side view of the conventional condenser microphone illustrated in FIG. 12.
Figure 15:
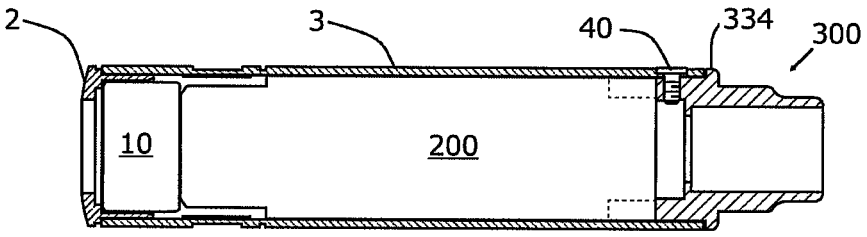
RELATED ART FIG. 15
FIG. 15 is a cross-sectional plan view of the conventional condenser microphone illustrated in FIG. 12.

FIG. 10 is an external view of the condenser microphone of the present invention. FIG. 11 is an exploded component view of the condenser microphone illustrated in FIG. 10.

The condenser microphone 1 is a gooseneck type, for example, that includes a cap 2, a microphone case 3, a rear case 30, a gooseneck pipe 4A, a pipe 5, a joint 6, a gooseneck pipe 4B, and a connector case 7.

The present invention will now be exemplified with a gooseneck type condenser microphone. The condenser microphone according to the present invention applies not only to the gooseneck type, but also to other microphones which require compact microphone units, such as lavalier microphones and wireless microphones.

As described above, the unit 10 and the PCB 20 are accommodated in the microphone case 3. The front end (depicted in the lower portion of FIG. 10) of the microphone case 3, which is directed to the sound source during sound collection is covered with the cap 2. The rear end (depicted in the upper portion of FIG. 10) of the microphone case 3 is coupled to the flexible gooseneck pipe 4A through the rear case 30. One end of the pipe 5 that is made of metal and is in a straight tube shape is coupled to the gooseneck pipe 4A. One end of the gooseneck pipe 4B is coupled to the other end of the pipe 5 through the joint 6. The connector case 7 accommodating a connector 8 is coupled to the other end of the gooseneck pipe 4B.

The connector 8 is an output connector including a first pin for grounding, a second pin on the hot signal side, and a third pin on the cold signal side that are in conformance with JEITA Standard RC-5236 "Circular Connectors, Latch Lock Type for Audio Equipment", for example.

The PCB 20 accommodates a balanced transmission circuit. The PCB 20 is electrically connected with the connector 8 through a microphone cable 9. The microphone cable 9 is inserted into the gooseneck pipe 4A, 4B and the pipe 5. The microphone cable 9 is a double-core shielded cable consisting of a hot signal line, a cold signal line, and a braided shielding wire.

The braided shielding wire of the microphone cable 9 is connected with a ground (grounded circuit) of the PCB 20 through the ground lands 23 of the PCB 20, for example. The ground of the PCB 20 is connected with the first pin of the connector 8. The first pin is also connected with a shield housing (not shown). The connection between the connector 8 and the microphone cable 9 is established as follows. The hot signal line of the microphone cable 9 is connected with the second pin of the connector 8. The cold signal line of the microphone cable 9 is connected with the third pin of the connector 8. The braided shielding wire is connected with the first pin of the connector 8.

The unit 10 accommodates a field effect transistor (FET) functioning as an impedance converter. The FET includes a gate electrode, a drain electrode, and a source electrode. The two signal lines of the microphone cable 9 are connected with the source electrode through the PCB 20. The audio-signals output from the FET are unbalanced signals. The audio-signals output from the FET as unbalanced signals are converted into balanced signals at the PCB 20 and are then sent to the microphone cable 9.

CONCLUSION

In the condenser microphone according to the embodiment described above, the PCB 20 is electrically connected with the rear case 30 through the C-ring 50 fitted in the mounting groove 31*b*. Such a configuration can establish stable electrical connection between the PCB 20 and the rear case 30.

In addition, the microphone case 3 is electrically connected with the PCB 20 through the C-ring 50. Such a configuration can establish stable electrical connection between the microphone case 3 and the rear case 30 through the C-ring 50 and the PCB 20.

The invention claimed is:

1. A condenser microphone comprising:

a microphone unit;

an audio-signal outputting printed circuit board connected with the microphone unit;

a rear case having a deep groove, the deep groove receiving the audio-signal outputting printed circuit board;

a mounting groove being formed on the outer periphery of the rear case, the mounting groove receiving a mounting member; and a fitting groove being formed on the audio-signal outputting printed circuit board, the fitting groove receiving the mounting member, wherein the mounting groove is communicated with the deep groove.

2. The condenser microphone according to claim 1, wherein the audio-signal outputting printed circuit board is inserted into the rear case such that the fitting groove is communicated with the mounting groove.

3. The condenser microphone according to claim 2, wherein the rear case is in a cylindrical shape, the mounting groove is formed on the outer periphery of the rear case, and the mounting member comprises a C-ring.

4. The condenser microphone according to claim 1, wherein the mounting member comprises an elastic material.

5. The condenser microphone according to claim 1, further comprising:

a microphone case being in a cylindrical shape and accommodating the microphone unit and the audio-signal outputting printed board, wherein the rear case is inserted into one of open ends of the microphone case, and the rear case is fixed to the microphone case with a fixing member.

6. The condenser microphone according to claim 1, wherein the audio-signal outputting printed circuit board is in a plate shape, and the fitting grooves are respectively formed on opposite long sides of the audio-signal outputting printed circuit board.

7. A method of manufacturing a condenser microphone, the condenser microphone comprising:

a microphone unit;

an audio-signal outputting printed circuit board being connected with the microphone unit; and a rear case having deep groove, the deep groove receiving the audio-signal outputting printed circuit board, a mounting groove is formed on the outer periphery of the rear case, the mounting groove receiving a mounting member, a fitting groove is formed on the one of end portions of the audio-signal outputting printed circuit board, the fitting groove receiving the mounting member, the method comprising the steps of:

a) receiving the one of the end portions of the audio-signal outputting printed circuit board into the deep groove;

b) fitting the mounting member into the mounting groove; and c) accommodating the audio-signal outputting printed circuit board into the microphone case, the fitting groove of the audio-signal outputting printed circuit board receiving the mounting member, the mounting member being received the mounting groove.

8. The method according to claim 7, wherein step b) is performed before step a).

9. The method according to claim 7, wherein step b) is performed after step a).

10. A condenser microphone comprising:

a microphone unit;

an audio-signal outputting printed circuit board connected with the microphone unit;

a rear case having a deep groove, the deep groove receiving the audio-signal outputting printed circuit board;

a mounting groove being formed on the outer periphery of the rear case, the mounting groove receiving a mounting member;

a fitting groove being formed on the audio-signal outputting printed circuit board, the fitting groove receiving the mounting member; and a ground land disposed adjacent to the fitting groove of the audio-signal outputting printed circuit board.

11. The condenser microphone according to claim 10, wherein the rear case and the mounting member have conductivity, and the ground land is electrically connected with the rear case through the mounting member.

12. The condenser microphone according to claim 10, wherein the mounting member comprises an elastic material.

13. The condenser microphone according to claim 10, further comprising:

a microphone case being in a cylindrical shape and accommodating the microphone unit and the audio-signal outputting printed board, wherein the rear case is inserted into one of open ends of the microphone case, and the rear case is fixed to the microphone case with a fixing member.

14. The condenser microphone according to claim 10, wherein the audio-signal outputting printed circuit board is in a plate shape, and the fitting grooves are respectively formed on opposite long sides of the audio-signal outputting printed circuit board.

* * * * *